US008989394B2

(12) United States Patent
Cho et al.

(10) Patent No.: US 8,989,394 B2
(45) Date of Patent: Mar. 24, 2015

(54) ACTIVE DELAY METHOD AND A IMPROVED WIRELESS BINAURAL HEARING DEVICE USING THE SAME METHOD

(75) Inventors: Jin Ho Cho, Dae-Gu Si (KR); Ki Woong Seong, Dae-Gu Si (KR); Jyung Hyun Lee, Gyeongsan-Si (KR); Myoung Nam Kim, Dae-Gu Si (KR); Sang Hyo Woo, Dae-Gu Si (KR)

(73) Assignee: Kyunpook National University Academic Industry Cooperation Foundation, Dae-Gu Si (KR)

( * ) Notice: Subject to any disclaimer, the term of this patent is extended or adjusted under 35 U.S.C. 154(b) by 482 days.

(21) Appl. No.: 13/244,285

(22) Filed: Sep. 24, 2011

(65) Prior Publication Data

US 2012/0328111 A1 Dec. 27, 2012

(30) Foreign Application Priority Data

Jun. 27, 2011 (KR) ..... 10-2011-0062399

(51) Int. Cl.
*H04R 25/00* (2006.01)
*H04S 1/00* (2006.01)

(52) U.S. Cl.
CPC ..... *H04R 25/43* (2013.01); *H04R 25/554* (2013.01); *H04S 1/00* (2013.01)
USPC ..... 381/23.1; 381/1; 381/6; 381/91; 381/102; 455/575.2

(58) Field of Classification Search
USPC ..... 381/1, 2, 6, 14, 16, 22, 23, 23.1, 26, 61, 381/314, 315, 74, 332, 91, 92, 97, 98, 99, 381/100, 101, 102, 103, 110, 119, 122; 455/575.2, 575.3, 575.4; 700/94
See application file for complete search history.

(56) References Cited

U.S. PATENT DOCUMENTS

| | | | | |
|---|---|---|---|---|
| 4,581,759 | A * | 4/1986 | Takahashi | 381/97 |
| 2001/0028720 | A1* | 10/2001 | Hou | 381/92 |
| 2007/0230714 | A1* | 10/2007 | Armstrong | 381/74 |
| 2010/0128907 | A1* | 5/2010 | Dijkstra et al. | 381/315 |
| 2010/0158292 | A1* | 6/2010 | Pedersen | 381/315 |

* cited by examiner

*Primary Examiner* — Leshui Zhang
(74) *Attorney, Agent, or Firm* — Revolution IP, PLLC

(57) ABSTRACT

Disclosed are an active delay method and an improved wireless binaural hearing device. The binaural hearing device includes: a first hearing device including a first microphone, an amplifier and a wireless transmitter; and a second hearing device including a second microphone, an amplifier, a wireless transmitter, a wireless receiver which receives a signal from the wireless transmitter, an active delay circuit which synchronizes the received signal with a signal acquired by the second microphone, a neural network which synchronizes the delayed signal, and a speaker which converts the synchronized signal into a voice signal. With this configuration, it is possible to prevent incorrect detection of the position of the sound source or paralalia due to a time delay which is produced in the wireless binaural hearing device and reduce noises due to a time difference between both hearing devices, thereby providing a binaural hearing device with high quality.

10 Claims, 4 Drawing Sheets

- Prior Art –

- Prior Art –

| ChunkID | ChunkSize | SampleRate | Time | Data | CRC |
|---|---|---|---|---|---|

ACTIVE DELAY METHOD AND A IMPROVED WIRELESS BINAURAL HEARING DEVICE USING THE SAME METHOD

BACKGROUND OF THE INVENTION

1. Field of the Invention

The present invention relates to an active delay method which is capable of synchronizing a binaural hearing device stably by reducing a time difference which may be produced due to wireless connection of two hearing devices, and a wireless binaural hearing device using the same method.

2. Description of the Related Art

In recent years, approaches have been frequently researched which uses a binaural hearing device to strengthen user's hearing. A binaural hearing device is a device which processes signals acquired through two or more hearing devices or microphones attached to ears or a neck and transfers the processed signals to user's ears. Use of the binaural hearing device can improve user's hearing and allows the user to detect a position of a sound source reliably.

However, existing hearing devices have to be equipped with several microphones connected to each other by wires, which detracts from the beauty.

To avoid such a demerit, many attempts to transmit signals of a binaural hearing device by wireless have been made. Such attempts have focused on a wireless transmission system which can transmit signals acquired by one hearing device to another hearing device.

However, such a wireless transmission system cannot avoid producing a signal delay for signal modulation-demodulation and verification, as compared to a wired transmission system. General wireless systems may be used with no problem since they recognize a sound source to be just a little apart from them even if a time delay of 10 to 50 ms is produced. However, for a binaural algorithm, a delay measured in microphones is a very important factor as shown in FIG. 1. If a sound source is in front of two microphones, time of input of a signal in the left microphone is equal to time of input of the signal in the right microphone. However, if the sound is in the left side, the signal is measured in the left microphone and then, after a certain period of time, the signal is input to the right microphone. Therefore, the existing wireless binaural hearing devices have been designed to use this signal delay to improve user's hearing.

However, such wireless binaural hearing devices require wireless transmission time of about 10 to 50 ms, which may result in low sound recognition. FIG. 2 is a schematic view showing variation of a position of a sound source in the presence of a wireless binaural hearing device. If the sound source lies in front of the wireless binaural hearing device, a signal from the sound source arrives at both hearing devices in equal time. When the signal is transmitted to both binaural hearing devices by wireless in this manner, there occurs a signal delay, which makes a user feel as if the position of the sound source is shifted to the left or right side. For example, if the signal enters the left hearing device by a wire and data are transmitted to the right hearing device by wireless, the left hearing device may create an illusion that the sound source is in the left side. In the reverse case, the left hearing device may create an illusion that the sound source is in the right side.

SUMMARY OF THE INVENTION

To overcome the above problems, it is an object of the invention to provide a wireless binaural hearing device which is capable of eliminating the detraction from the beauty due to wired connection of microphones, preventing incorrect detection of a position of a sound source or paralalia due to a time delay which is produced in a wireless binaural hearing device and reducing noises due to a time difference between both hearing devices, thereby providing a binaural hearing device with high quality.

To achieve the above object, according to the first aspect of the invention, there is provided a binaural hearing device with improved performance through an active delay, including: a first hearing device including a first microphone, an amplifier and a wireless transmitter; and a second hearing device including a second microphone, an amplifier, a wireless transmitter, a wireless receiver which receives a signal from the wireless transmitter, an active delay circuit which synchronizes the received signal with a signal acquired by the second microphone, a neural network which synchronizes the delayed signal, and a speaker which converts the synchronized signal into a voice signal.

Preferably, the active delay circuit includes: a RSSI measuring unit which acquires strength of the received signal; and an adaptive delay element which acquires a time delay per wireless data packet of the received signal.

Preferably, the adaptive delay element includes a local oscillator and a PLL circuit.

According to the second aspect of the invention, there is provided an active delay method in a binaural hearing device, comprising the steps of: (a) acquiring sound signals through microphones of a first hearing device and a second hearing device and converting the acquired sound signals into digital signals; (b) transmitting the signal acquired in the first hearing device to the second hearing device by means of a RF transmitter of the first hearing device; (c) receiving the signal by means of a RF receiver of the second hearing device; and (d) adaptively synchronizing the wirelessly received signal with the signal of the second hearing device.

Preferably, the step (a) includes the steps of: acquiring the sound signals through microphones; amplifying the acquired sound signals and filtering the amplified signals in a predetermined frequency band; and converting the filtered signals into digital signals.

Preferably, the step (d) includes the steps of: acquiring a RSSI and a time delay; and synchronizing the signals of the first and the second hearing devices by adaptively delaying the signals using the acquired RSSI and time delay.

Preferably, the time delay is a time delay per wireless data packet.

Preferably, the data packet contains time data.

Preferably, the synchronizing step includes the step of acquiring the time delay per wireless data packet and then determining a total time delay using a neural network.

Preferably, the synchronizing step includes the steps of: comparing the signal received in a RF receiver of the second hearing device with a signal of a local oscillator; and synchronizing phases of the signals of the first and the second hearing devices using a PLL circuit.

According to the present invention, it is possible to prevent incorrect detection of the position of the sound source or paralalia due to a time delay which is produced in the wireless binaural hearing device and reduce noises due to a time difference between both hearing devices, thereby providing a binaural hearing device with high quality.

In addition, this invention provides a hearing device which predicts a possible time delay by detecting conditions of wireless channel, stores signals in a temporary repository, and outputs the signals in synchronization with a synchronized system. In addition, this invention provides an improved binaural hearing device and an active delay method which are capable of inserting time data in a form of data in preparation for improper data transmission to facilitate signal data synchronization even in case of failure of data transmission.

DETAILED DESCRIPTION OF PREFERRED EMBODIMENTS

Figure 1:
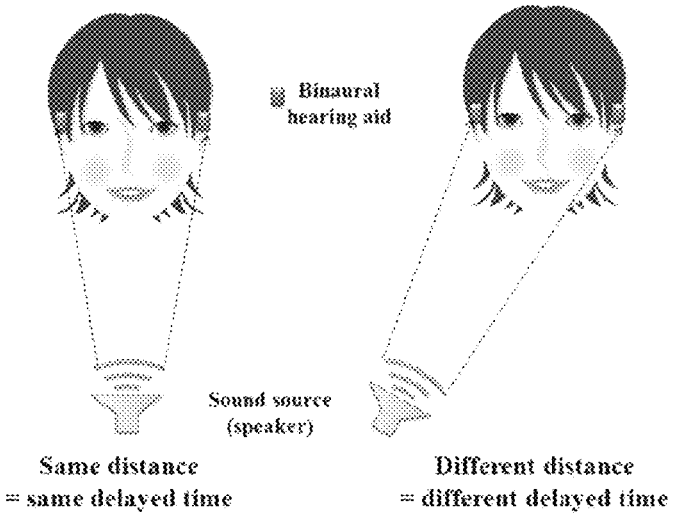
FIG. 1 is a schematic view showing a time difference between both hearing devices when a sound source is in front and when the sound source is in the side.
Figure 2:
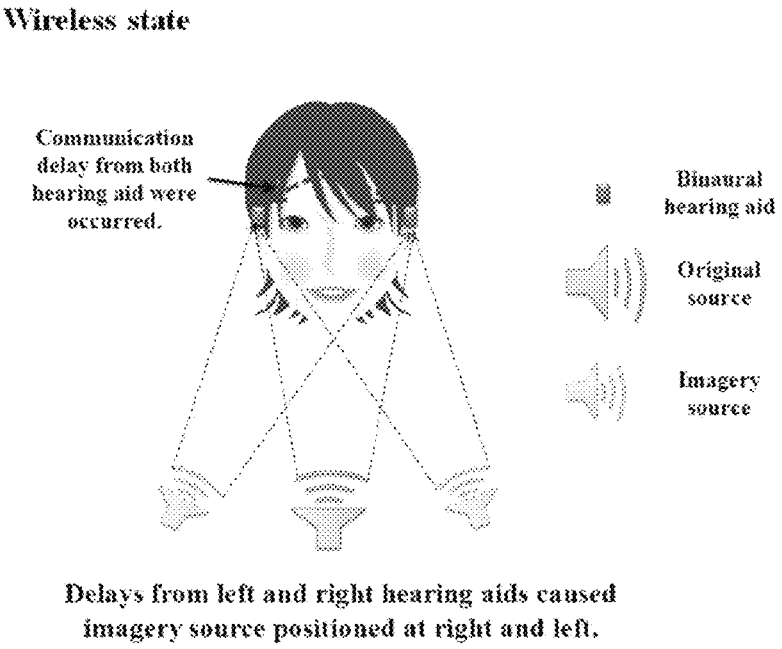
FIG. 2 is a schematic view showing a time delay which is produced when a wireless binaural hearing device is used.

The above and other objects, advantages, features and methods will be better understood when reading the following detailed description and the accompanying drawings. However, it should be understood that the present invention is not limited to the disclosed embodiments but may be embodied in other various forms. The disclosed embodiments are provided to describe the present invention in detail so that those skilled in the art can practice the technical ideas of the present invention.

In the drawings, elements of the embodiments are not shown in a limited sense but may be exaggerated for clarity. Throughout the drawings, same reference numerals denote same or similar elements.

In the specification, as used herein, the term "and/or" is meant to include at least one of elements arranged before and after. In addition, a singular form "a" or "an" is meant to include a plural form unless stated specifically otherwise. In addition, as used herein, the term "comprise(s)" or "comprising" is meant to include or add one or more of elements, steps, operations, devices and apparatuses other than those mentioned in the specification.

Hereinafter, preferred embodiments of the present invention will be described in detail with reference to the drawings.

Figure 3:
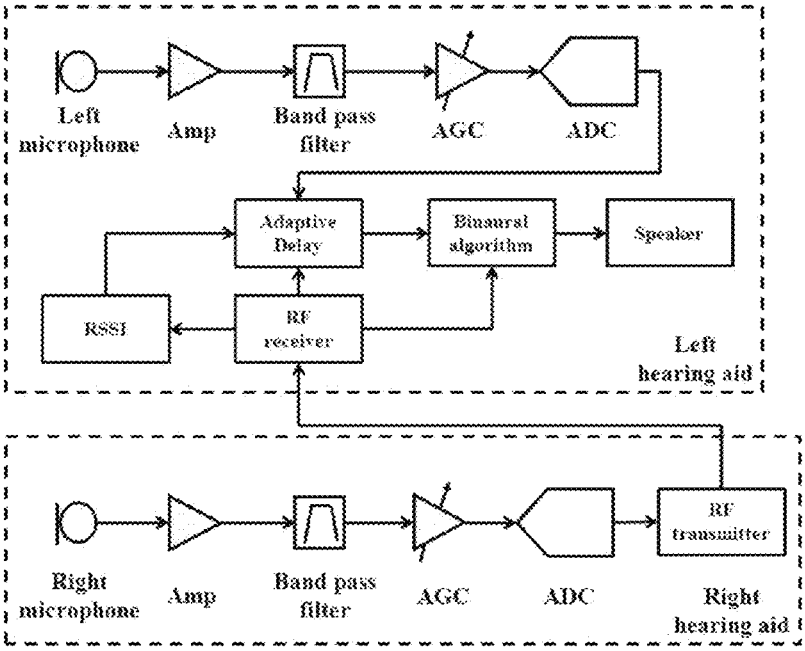
FIG. 3 is a block diagram showing a configuration of a wireless binaural hearing device with improved performance through an active delay according to an embodiment of the present invention.

FIG. 3 is a block diagram showing a configuration of a wireless binaural hearing device with improved performance through an active delay according to an embodiment of the present invention. As shown in FIG. 3, a wireless binaural hearing device of this invention includes a first hearing device including a first microphone, an amplifier and a wireless transmitter; and a second hearing device including a second microphone, an amplifier, a wireless transmitter, a wireless receiver which receives a signal from the wireless transmitter, an active delay circuit which synchronizes the received signal with a signal acquired by the second microphone, a neural network which synchronizes the delayed signal, and a speaker which converts the synchronized signal into a voice signal.

Here, the first hearing device and the second hearing device mean a left hearing device and a right hearing device, respectively, but it is not necessarily meant to specify one of them. For example, this invention proposes to receive a wireless signal transmitted via sire from a microphone of the second hearing device and synchronize at the first hearing device the wirelessly received signal from the second hearing device with a signal transmitted from a microphone of the first hearing device through an active delay.

With this configuration, it is possible to prevent incorrect detection of the position of the sound source or paralalia due to a time delay which is produced in the wireless binaural hearing device and reduce noises due to a time difference between both hearing devices, thereby providing a binaural hearing device with high quality.

Referring to FIG. 3, a signal acquired in the right side is transmitted to the left microphone by wireless and a wired signal measured in the left side is delayed until the wired signal is in synchronization with the wireless signal. In this embodiment, the delay is of an active type, although it may be of a passive type.

In this manner, in this invention, it is possible to search interference of a wireless network signal and RSSI and actively delay the signal using the searched RSSI. The delayed signal is transferred to a binaural hearing device algorithm and is transmitted to the speaker. As shown in FIG. 3, the signal may be transmitted from the right microphone to the left microphone and vice versa.

In this embodiment, the right hearing device is designated as the first hearing device and the left hearing device is designated as the second hearing device. The first hearing device or the right hearing device includes a microphone, an amplifier, a band pass filter, an analog to digital converter (ADC) and a RF transmitter.

As shown in FIG. 3, an external sound signal is acquired in the microphone of the first hearing device or the left hearing device and is transmitted, as a digital signal, from the RF transmitter to the second hearing device (the left hearing device) through the amplifier, the band pass filter and the ADC.

The second hearing device receives the digital signal in a RF receiver, acquires signal strength and a time delay per wireless data packet of signal data, determines a total time delay, synchronizes its signal and the signal of the first hearing device using a neural network (or binaural algorithm), and output the synchronized signals to the speaker.

Figure 4:
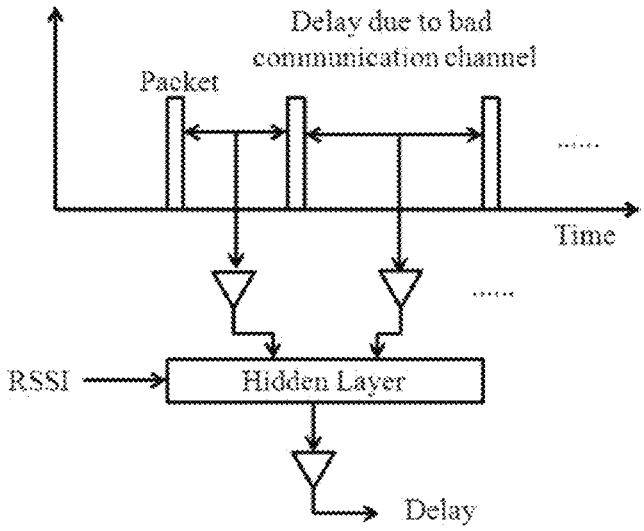
FIG. 4 is a conceptual view of an active delay element in consideration of wireless network strength and interference applied to the wireless binaural hearing device according to an embodiment of the present invention.
Figures 5, 6:
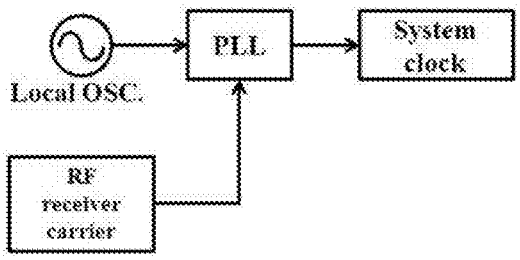
FIG. 5 is a view showing one example of a signal packet applied to this invention.
FIG. 6 is a schematic view for explaining a method of synchronizing two systems using wireless communication applied to this invention.

FIG. 4 is a conceptual view of an active delay element in consideration of wireless network strength and interference applied to the wireless binaural hearing device according to an embodiment of the present invention, and FIG. 5 is a view showing one example of a signal packet applied to this invention.

FIG. 4 shows a structure where the first hearing device acquires RSSI and a time delay per wireless data packet and determines the total time delay using the neural network (binaural algorithm).

As shown in FIG. 5, an example of the data packet is configured as the general type of packet including an ID, size, sampling rate, data, CRC and so on, and further includes general time data. The time data is absolute time in preparation for intermediate evanishment of a wireless signal. A receiver may use this time data to detect the intermediate evanishment of the wireless signal and compensate for this evanishment.

In this case, synchronization of both hearing devices may be varied over a long period of time due to an inaccurate crystal oscillation frequency of each system. If the hearing device is used for more than a day, synchronization of time data in a packet may be incorrect. Thus, this invention proposes a synchronization method using a PLL circuit in order to overcome this problem.

FIG. 6 is a schematic view for explaining a method of synchronizing two systems using wireless communication applied to this invention. FIG. 6 shows a method where a signal received from the first hearing device is compared with a signal acquired in a local oscillator and the PLL circuit synchronizes phases of both signals based on a result of the comparison.

The PLL circuit used herein is a circuit which detects a phase difference between an input signal and an output signal, controls a phase of an output signal generator with a voltage proportional to this phase difference, and makes the phase of the input signal equal to the phase of the output signal, such as an automatic phase control loop including a phase comparator, a low pass filter, an error amplifier and a voltage controlled oscillator. The PLL circuit is frequently used as a frequency oscillation source of a frequency synthesizer or a radio transceiver.

In this manner, in this invention, it is possible to acquire a high quality hearing device output signal by synchronizing phases of signals using the PLL circuit to compensate for low accuracy due to a prolonged use of crystal oscillation frequency of each system.

Figure 7:
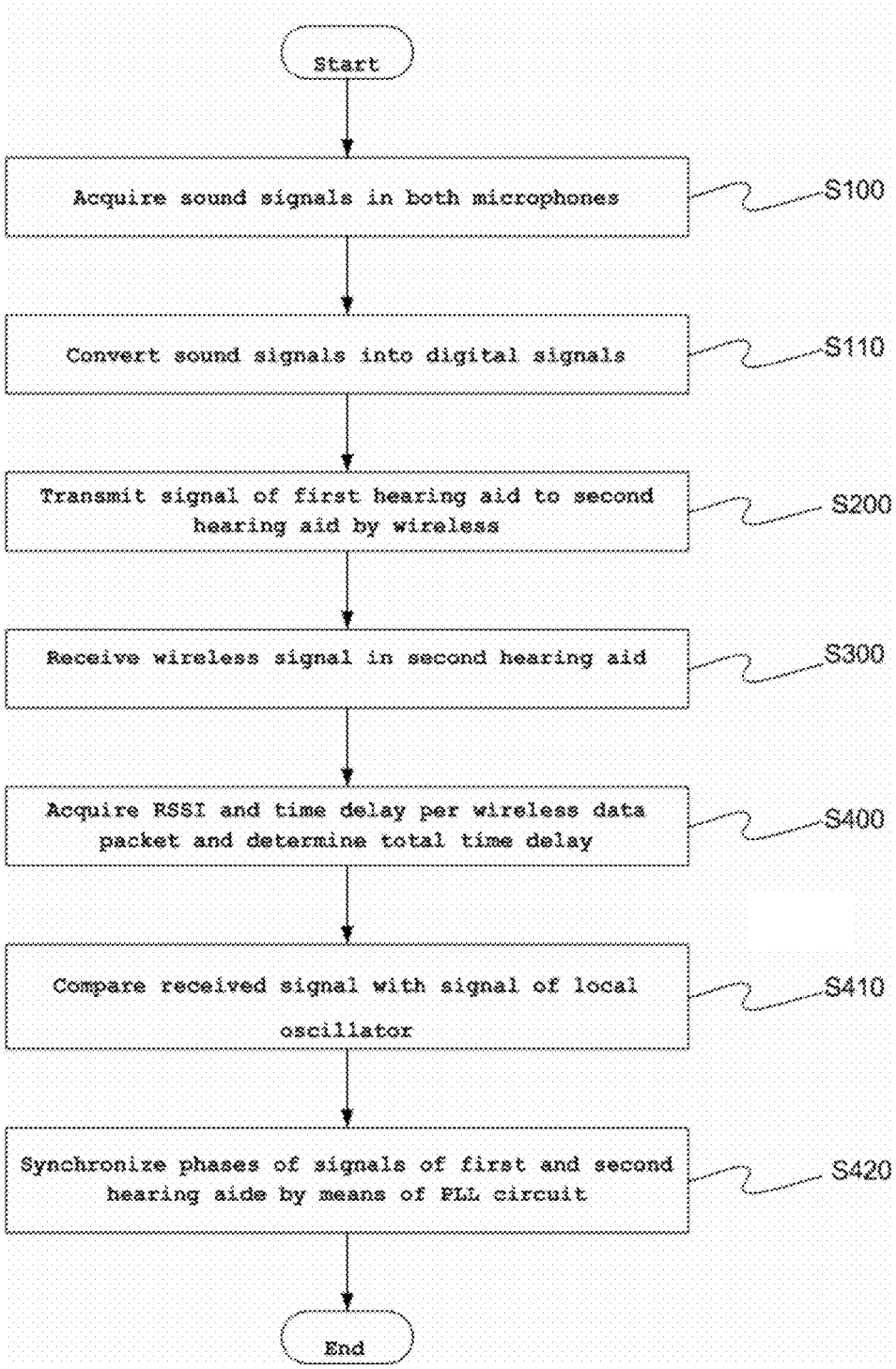
FIG. 7 is a flow chart showing an active delay method of a binaural hearing device for improvement of performance.

FIG. 7 is a flow chart showing an active delay method of a binaural hearing device for improvement of performance. As shown in FIG. 7, an active delay method of a binaural hearing device of this invention includes the steps of: (a) acquiring sound signals through microphones of a first hearing device and a second hearing device and converting the acquired sound signals into digital signals (S100 and S110); (b) transmitting the signal acquired in the first hearing device to the second hearing device by means of a RF transmitter of the first hearing device (S200); (c) receiving the signal by means of a RF receiver of the second hearing device (S300); and (d) adaptively synchronizing the wirelessly received signal with the signal of the second hearing device (S400, S410 and S420).

In more detail, external sound signals are acquired in microphones of both hearing devices (S100), and the sound signals are converted into digital signals through an amplifier, a band pass filter and an ADC of each hearing device (S110). The converted signals are transmitted to the second hearing device via the RF transmitter of the first hearing device (S200), the signals are received in the RF receiver of the second hearing device (S300), and a total time delay is determined after an RSSI and a time delay per wireless data packet (S400).

Once the total time delay is determined, the received signal is delayed by the time delay and is synchronized with the signal of the second hearing device. In this embodiment, in order to overcome difficulty in data synchronization due to a prolonged use of the binaural hearing device, the received signal is compared with a signal of a local oscillator (S410), and the signals of the first and the second hearing devices are delayed by the time delay using the PLL circuit to synchronize phases of both signals (S420).

As described above, this invention provides a method of synchronizing a plurality of wireless hearing devices and a system using the same. In particular, this invention provides a hearing device system which predicts a possible time delay by detecting conditions of wireless channel, stores signals in a temporary repository, and outputs the signals in synchronization with a synchronized system. In addition, this invention provides an improved binaural hearing device and an active delay method which are capable of inserting time data in a form of data in preparation for improper data transmission to facilitate signal data synchronization even in case of failure of data transmission.

Although a few exemplary embodiments have been shown and described, it will be appreciated by those skilled in the art that adaptations and changes may be made in these exemplary embodiments without departing from the spirit and scope of the invention, the scope of which is defined in the appended claims and their equivalents.

What is claimed is:

1. A binaural hearing device with improved performance through an adaptive delay, comprising:

a first hearing device acquiring a first sound signal, and transmitting a digital signal corresponding to the first sound signal; and a second hearing device receiving the digital signal wirelessly transmitted from the first hearing device, wherein the second hearing device comprises:

a received signal strength indication measuring unit configured to measure a strength of the received digital signal wirelessly transmitted from the first hearing device, and an adaptive delay circuit configured to adaptively synchronize the received digital signal wirelessly transmitted from the first hearing device with a second sound signal acquired by the second hearing device, the adaptive synchronization being performed by equalizing a phase of the received digital signal wirelessly transmitted from the first hearing device to a phase of the second sound signal acquired by the second hearing device, the adaptive delay circuit further configured to determine a time delay generated per wireless data packet of the received digital signal wirelessly transmitted from the first hearing device based on the measured strength of the received digital signal wirelessly transmitted from the first hearing device by the RSSI measuring unit and to adaptively synchronize the received digital signal wirelessly transmitted from the first hearing device with the second sound signal acquired by the second hearing device based on the determined time delay.

2. The binaural hearing device according to claim 1, wherein the adaptive delay circuit includes a local oscillator and a PLL circuit.

3. An adaptive delay method in a binaural hearing device, comprising the steps of:

acquiring a first sound and a second sound signals through a first and a second microphones of a first and a second hearing devices respectively;

converting the first sound signal into a digital RF signal, and converting the second sound signal into a digital sound signal;

wirelessly transmitting the digital RF signal to the second hearing device;

receiving the digital RF signal wirelessly transmitted from the first hearing device to the second hearing device, the second hearing device having a received signal strength indication RSSI measuring unit configured to measure a strength of the received digital RF signal wirelessly transmitted from the first hearing device; and adaptively actively synchronizing the received digital RF signal wirelessly transmitted from the first hearing device with the digital sound signal of the second hearing device, the adaptive synchronization being performed by equalizing a phase of the received digital RF signal wirelessly transmitted from the first hearing device to a phase of the second sound signal of the second hearing device in response to detection of the strength of the received digital RF signal transmitted from the first hearing device, determining a time delay generated per wireless data packet of the received digital RF signal wirelessly transmitted from the first hearing device based on the strength measured by the RSSI measuring unit, and adaptively synchronizing the received digital RF signal wirelessly transmitted from the first hearing device with the second sound signal of the second hearing device based on the determined time delay.

4. The adaptive delay method according to claim 3, wherein the first and second sound signals are amplified to produce amplified first and second sound signals respectively and the amplified first and second sound signals are filtered to produce filtered first and second sound signals respectively in a predetermined frequency band, and the filtered first and second sound signals are converted into the digital RF signal and the digital sound signal, respectively.

5. The adaptive delay method according to claim 3, wherein the data packet of the received digital RF signal wirelessly transmitted from the first hearing device contains time data.

6. The adaptive delay method according to claim 3, wherein the determined time delay is acquired per wireless data packet and then a total delay time is determined by a binaural algorithm.

7. The adaptive delay method according to claim 3, wherein the digital RF signal received in a RF receiver of the second hearing device is compared with a signal of a local oscillator; and phases are adaptively synchronized between the received digital RF signal wirelessly transmitted from the first hearing device and the digital sound signal of the second hearing device using a PLL circuit.

8. A binaural hearing device comprising:

a first hearing device comprising a first microphone configured to receive a first sound and a transmitter configured to receive a RF digital signal corresponding to the first sound signal; and a second hearing device wirelessly communicating with the first hearing device, the second hearing device comprising:

a second microphone;

a receiver configured to receive the RF digital signal wirelessly transmitted from the transmitter of the first hearing device;

a received signal strength indication RSSI measuring unit configured to measure a strength of the received RF digital signal wirelessly transmitted from the transmitter of the first hearing device;

an adaptive delay circuit configured to adaptively synchronize the received RF digital signal wirelessly transmitted from the transmitter of the first hearing device with a second sound signal acquired by the second microphone of the second hearing device by determining a time delay generated per wireless data packet of the received RF digital signal wirelessly transmitted from the transmitter of the first hearing device in response to a detection of the measured strength of the received RF digital signal wirelessly transmitted from the transmitter of the first hearing device by the RSSI measuring unit.

9. The binaural hearing device according to claim 8, wherein the adaptive delay circuit includes a local oscillator and a PLL circuit.

10. The binaural hearing device according to claim 8, wherein the second hearing device further comprises a converting converter configured to convert the adaptively synchronized signal into a voice signal.

* * * * *